US008714207B2

(12) United States Patent
Imhof

(10) Patent No.: US 8,714,207 B2
(45) Date of Patent: May 6, 2014

(54) VERTICAL ROUND CONTAINER FOR STORING LIQUIDS, AND ARRANGEMENT COMPRISING A PLURALITY OF CONTAINERS

(76) Inventor: Heinrich Imhof, Obertshausen (DE)

( * ) Notice: Subject to any disclaimer, the term of this patent is extended or adjusted under 35 U.S.C. 154(b) by 933 days.

(21) Appl. No.: 12/310,262

(22) PCT Filed: Aug. 15, 2007

(86) PCT No.: PCT/EP2007/007194

§ 371 (c)(1),
(2), (4) Date: Feb. 18, 2009

(87) PCT Pub. No.: WO2008/025454

PCT Pub. Date: Mar. 6, 2008

(65) Prior Publication Data

US 2009/0321447 A1 Dec. 31, 2009

(30) Foreign Application Priority Data

Aug. 31, 2006 (DE) ..... 10 2006 040 895

(51) Int. Cl.
*B65B 1/04* (2006.01)

(52) U.S. Cl.
USPC ..... 141/27; 141/23; 141/46; 141/47; 141/51

(58) Field of Classification Search
USPC ..... 141/4–5, 22, 23, 25, 26, 27, 46–51; 220/216–227
See application file for complete search history.

(56) References Cited

U.S. PATENT DOCUMENTS 3,120,902 A 2/1964 Southworth et al.

FOREIGN PATENT DOCUMENTS

| | | |
|---|---|---|
| EP | 0 059 298 | 9/1982 |
| EP | 0 635 440 | 1/1995 |
| GB | 300 086 | 11/1928 |
| JP | 56-74470 | 6/1981 |

*Primary Examiner* — Christopher Kim
(74) *Attorney, Agent, or Firm* — Karl F. Milde, Jr.; Eckert Seamans Cherin & Mellott, LLC

(57) ABSTRACT

A vertical round container (1) for storing liquids comprises a floating cover (6) covering the surface of the liquid. The cover is sealed in relation to the container wall by means of flexible sealing elements (18, 19) and includes, on the lower side thereof, at least one compartment (62) which is open towards the liquid and contains gaseous media/vapors. Devices (40*a*) are provided for determining the submersion depth of the cover, and supply/discharge lines (29) are provided for modifying the quantity of the gaseous medium in the at least one compartment. The supply/discharge lines for the gaseous medium are connected to a central unit (28) provided outside the container region.

19 Claims, 7 Drawing Sheets

VERTICAL ROUND CONTAINER FOR STORING LIQUIDS, AND ARRANGEMENT COMPRISING A PLURALITY OF CONTAINERS

BACKGROUND OF THE INVENTION

The present invention relates to a vertical round container for storing liquids, the container having a floating cover that extends over and above the surface of the liquid with the cover sealed in relation to the container wall by means of flexible sealing elements. The floating cover has at least one compartment on its lower side which is open towards the liquid and in which gaseous media/vapors are entrapped. Sensing devices are provided for determining the immersion depth of the cover, and supply and discharge lines are provided for varying the quantity of the gaseous medium in the compartments.

A floating cover of this type is known from the published European Patent No. EP 0 059 298 A1.

Floating covers on liquid surfaces function to suppress the exchange between the two fluid media, the liquid and gas, in storage containers.

An important application of such floating covers is presented by large-volume storage containers for highly volatile mineral oil products. To solve the main problems—to prevent fire and explosion and to avoid emissions—the floating cover was developed approximately 80 years ago.

Following this development two main systems were pursued; namely, a tank or container with a floating cover without a fixed roof (also called an "external floating roof tank") and a tank with a fixed roof and an internally located floating cover (also called an "internal floating roof tank").

Since the problems created by residual emissions and precipitations in a container without fixed roof have not been solved in a satisfactory way, preference has primarily been given to containers with fixed roofs. The possibility has here been seen to dissolve emissions almost completely with the help of vapor balancing with corresponding containers and by vapor recovery and to dispense with the floating cover in the end.

The resulting technique, however, has decisive drawbacks.

All of the completely closed containers containing hydrocarbon vapors present a high risk of explosion and fire and are sensitive to vacuum and overpressure. The daily tank breathing by expanding and contracting gases in the container headspaces requires additional gas containers and the treatment of large gas volumes.

Vapor recovery is expensive and energy-consuming, and the total emission balance becomes negative as compared to containers with a floating cover.

It has therefore been evident that the most expedient methods for minimizing facility risks, total emissions and financial expenditure in storing highly volatile and combustible liquids, make use of the floating cover; consequently, this technique has not been abandoned. Ideally, the exchange balance between liquid and vapor must be established underneath the floating cover in closed chambers, so that evaporation comes to a standstill. However, this ideal case cannot be maintained permanently due to the necessary operating processes in the container and the presently used constructional solutions.

In practice, welded constructions of steel are exclusively used for external floating covers for refinery products. There are various other constructions for internal floating covers in the form of aluminum member structures with vapor chambers between membrane and liquid level and plastic membranes with direct contact with the liquid.

The above-mentioned EP 0 059298 A1 describes a floating cover for liquid containers which comprises a steel membrane slightly inclined towards the center, a wall on the peripheral side that extends from the plane of the membrane both upwards and downwards, with vapor cushions formed between the membrane and the liquid level underneath the membrane through a plurality of vertical partitions, these vapor cushions carrying the floating roof. The immersion depth of the floating roof is measured, and the floating position of the roof is trimmed by adding compressed air into individual buoyancy compartments. Excessive vapor or gas quantities underneath the roof are discharged into the atmosphere. In this floating roof, which has the form of a pantile construction with vapor cushions and which has a trim device for maintaining the horizontal float position, there is no pronounced water collection zone. This means that the water can settle on the roof to a minor extent, requiring frequent trimming with a supply of air underneath the membrane and later vapor discharge directly to the atmosphere. The entry of air or vapors with the filling of the container also requires the subsequent discharge of vapors into the atmosphere.

All of these trimming operations cause major emissions. In addition, there are the unsolved emission problems during filling and emptying of the container. Consequently, a floating cover of this type has not found practical application in the industry.

SUMMARY OF THE INVENTION

It is a principal object of the present invention to minimize or rule out possible emissions and operating risks on the storage container for highly volatile hydrocarbons in all operative states and in the case of complete emptying and first filling. It should be possible to compensate for the disruption of the safe floating position by precipitations, one-sided loading, input of gaseous media into the storage liquid and leakage, and the necessity to access the floating cover should be dropped; it should be possible to carry out all operating and controlling functions from outside of the container.

This object, as well as other objects which will become apparent from the discussion that follows, are achieved according to the present invention, by providing a vertical round container with the features of claim 1. A significant feature of the invention is that the supply/discharge lines for the gaseous medium are connected to a central unit provided outside the container. It is possible through this central unit to vary the gaseous media in the compartments such that the conditions prevailing in these compartments can be adapted to the existing requirements. The gaseous media in the compartments can be drawn off towards the central unit or, conversely, supplied from the central unit to the compartments to adjust the pressure in the compartments and the level of the floating cover.

It is possible to provide a line with respect to the various compartments of the floating cover that are open to the storage liquid, the line being connected to the central unit and used either as a supply line for supplying the gaseous medium to the compartments or as a discharge line to discharge the gaseous medium out of the compartments to the central unit. This can reduce to a minimum the number of necessary lines that pass from the central unit to the floating cover.

Particularly preferred is the arrangement of the supply/discharge lines through the liquid to the lower container edge or the container bottom and to connect them from there to the central unit. Any possible gas escaping out of these lines can thus be entrapped again underneath the floating cover and do not pass into the atmosphere. The lines guided through the liquid should be composed of rigid line sections that are again connected by articulated adapters. With this articulated arrangement the supply/discharge lines can be adapted to the respective height level of the floating cover. To make the articulated adapters flexible so that they can be adapted to all movements of the floating cover, the articulated adapters can be made of at least three hose joints.

To be able to maintain a floating cover in its horizontal orientation, especially when the floating cover is caused to move out of its normal position by external loads, such as rainwater or snow, at least three compartments that are open towards the storage liquid are preferably provided around the edge portion of the floating cover. These individual compartments, which will serve as trim compartments, are then each connected via a separate supply/discharge line to the central unit. Thus, the floating cover can be trimmed at the three points, distributed around the circumference, so that the supply or discharge of gaseous medium in the respective compartments can level the floating position of the floating cover.

Pontoon compartments closed at the liquid side may also be arranged in the peripheral portion of the floating cover, in ring-like configuration and/or in the form of sectors alternating with the trim compartments, so as to stabilize the floating position.

Furthermore, it is expedient to arrange a ring compartment that is open towards the liquid in an area positioned further towards the center, in which excessive gases and vapors, or gases and vapors or gases introduced by operation error into the containers, can collect centrally.

This ring compartment is not subdivided into partitioned compartments so that the same gas pressure prevails throughout the ring chamber.

To collect rainwater and water emanating from melting snow or ice on the upper side of the cover, a tub recessed towards the liquid is formed in the center of the cover, with the bottom of the tub immersed into the liquid. The collected water may be discharged through an articulated tube system out of the tub, the articulated tube system being connected on the one hand to an inlet pot in the center of the tub and on the other hand to the container wall near the bottom.

In comparison with the former constructions of floating covers with a small ring pontoon and a large middle membrane, the area of the tub is considerably reduced. The water is therefore more concentrated in the center of the floating cover, avoiding a possible list of the floating cover due to displacement of the collected water and wind load, one-sided frictional forces or other one-sided loads.

The quantity of water collected in the tub can be adjusted or discharged by controlling the level in response to the ambient requirements. Expediently, a certain minimum water quantity can be left in the tub during summer operation to exploit evaporation cooling for the storage liquid.

The central unit, as has been mentioned above, should comprise at least one gas control unit with a collection line, a compressor and a distributor line and valves so that each supply/discharge line is connectable to each other supply/discharge line via the compressor. Such an arrangement has the advantage that gaseous medium, which is e.g. discharged out of a chamber to the central unit, can be supplied through corresponding switching of the valves and via the compressor into another compartment so as to adjust the horizontal floating position of the floating cover. Discharge of ecologically harmful gases or vapors into the atmosphere is thereby avoided.

The liquid/vapor balance in the compartments open towards the liquid remains undisturbed and the further evaporation of the stored liquid is suppressed.

The potential emissions on peripheral portions of the floating cover or other emission portions (guide, control and measurement devices) can be drawn off by applying a partial vacuum by means of suction lines and a compressor to a gas utilization device following the central unit.

Likewise, the gases or vapors arising underneath the floating cover upon first filling or residual emptying of the container can be drawn off via a compressor and supplied to a gas utilization device.

In case of leakage of the floating cover it is possible to press air into the compartments that are open towards the liquid via the central unit and the supply/discharge lines and to carry out a provisional repair of the leakage places, if necessary.

The articulated tube system already mentioned above, which is used for discharging precipitations out of the tub, is normally of a constructionally stable design, so that such a water outlet line can be simultaneously used as a support element for the supply/discharge lines to the individual compartments and further emission sources in the supply/discharge lines are guided along this water outlet line.

Likewise, it is possible to supply a protective gas or inert gas to the various zones of the floating cover via the supply/discharge lines and suction lines instead of air. This can be expedient for avoiding harmful reactions or for avoiding enhanced corrosion in the open compartments of the floating cover.

To be able to detect the floating position of the floating cover, devices may be provided for determining the immersion depth of the cover, preferably at extreme points, and to adjust the horizontal position of the cover through displacement of the gaseous media into the respectively downwardly open compartments in dependence upon the measurement values.

The trim compartments, as indicated above, can be arranged underneath pontoon compartments, especially when already existing floating covers are to be retrofitted with such trim compartments.

Likewise, in case of retrofitting underneath the pontoon compartments and alternating with the trim compartments, downwardly open vapor collection compartments may be arranged that form a vapor ring compartment by being interconnected at the gas side.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
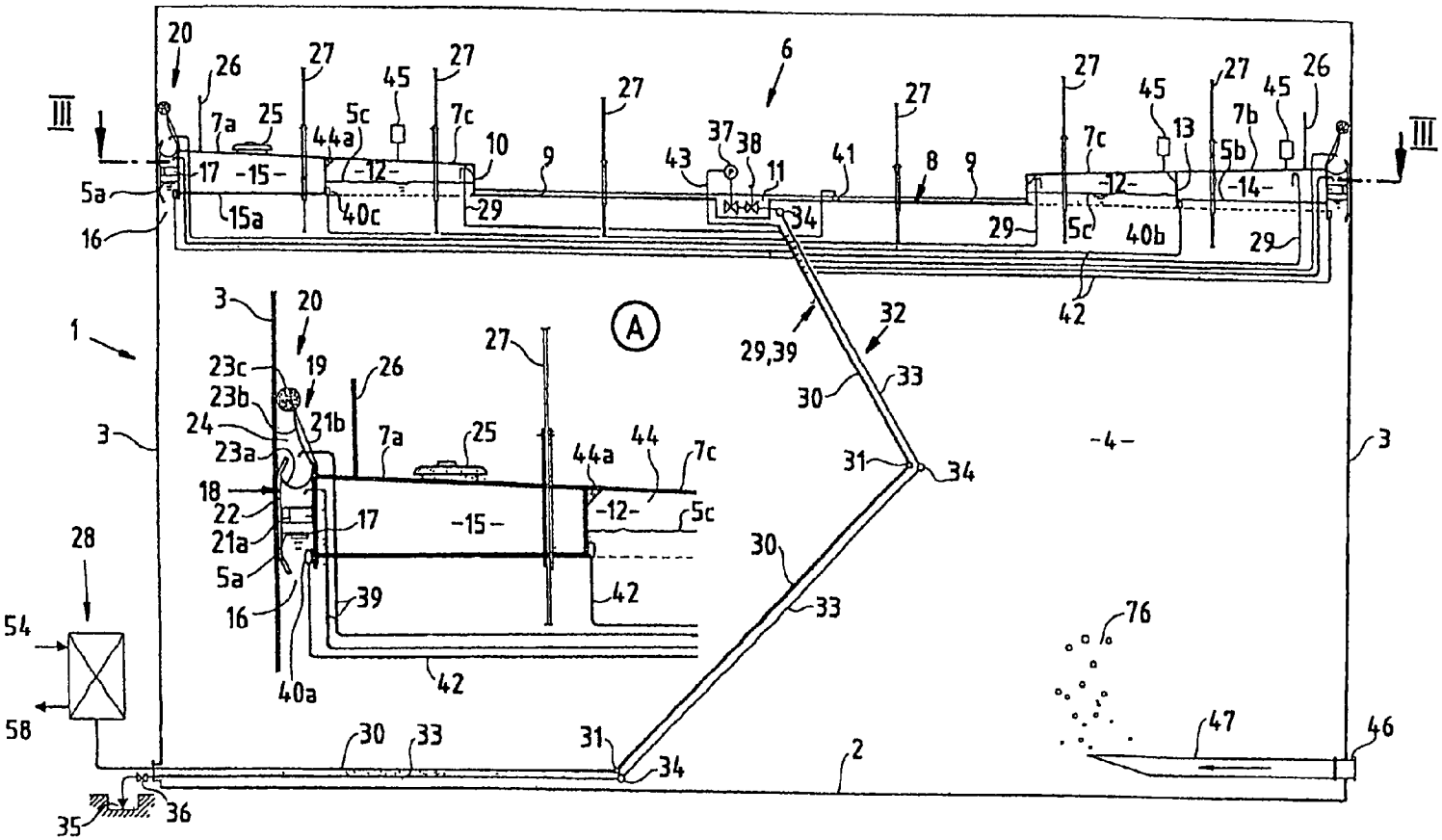
FIG. 1 is a vertical longitudinal section through the center of a vertical round container with floating cover without a fixed roof with a central unit located outside the container and with lines guided through the liquid chamber of the container, and including a detail drawing A of the sealing system between container wall and floating cover.

The preferred embodiments of the present invention will now be described with reference to FIGS. 1-8 of the drawings. Identical elements in the various figures are designated with the same reference numerals.

FIG. 1 shows a vertical round container 1 comprising a container bottom 2 and a container wall 3. The round container 1 is filled with storage liquid 4 up to a liquid surface, designated by reference numerals 5*a*, 5*b*, 5*c*. This round container 1 is of the type without a fixed roof.

The liquid surface 5*b*, 5*c* of the storage liquid 4 is covered with a floating cover 6, also called floating roof. The floating cover 6 is provided in the exterior region with a circular ring-shaped cover plate 7*a*, 7*b*, 7*c* which is slightly inclined towards the center of the container, and includes, in the center of the floating cover 6, a tub 8 which is deepened towards the storage liquid 4, formed of the bottom 9 and the side wall 10, with the bottom 9 of the tub immersed into the storage liquid 4. A pot-shaped recess 11 is formed in the center of the tub. The tub 8 serves to collect rainwater and melt water in the central region of the floating cover 6.

In the external region of the floating cover 6, two rows of compartments are provided, arranged in ring-like fashion around the center. In the section of the floating cover 6, as can be seen in FIG. 1, the two compartments located to the right side are compartments that are open to the underside, i.e. towards the liquid 4, and are separated by a vertical partition wall 13. These downwardly open compartments are designed in the outer region as individual and locally partitioned trim compartments 14 and further to the inside as one-part and concentric vapor ring compartments 12. At the left side of the cover 6, a pontoon compartment 15 provided with bottom plate 15*a* is arranged in the external region. At the radially interior side of the pontoon compartment 15 the vapor ring compartment 12 is positioned corresponding to the opposite side.

The area of the container wall 3 and the floating cover 6 with the pontoon compartment 15 and a part of the vapor ring compartment 12 is shown as detail "A" on an enlarged scale.

As can be seen with reference to the detail drawing "A", the ring compartment 16 between the container wall 3 and the peripheral plate 17 of the floating cover 6 is sealed with a bipartite peripheral seal 20; the peripheral seal 20 comprises a primary seal 18 and a secondary seal 19. The primary seal 18 is held by means of support arms 21*a* on the peripheral plate 17 of the floating cover 6 and is pressed against the inside of the container wall 3.

The slide plate 22 resting on the container wall 3 immerses into the storage liquid (surface 5*a*) and forms a closed vapor chamber together with the seal membrane 23*a* and the peripheral plate 17. The secondary seal 19 consists of support arms 21*b* and the seal profile 23*c* and the sealing membrane 23*b*. A space 24 is formed between primary seal 18 and secondary seal 19.

Furthermore, detail drawing A shows a pontoon manhole with lid 25 to permit access into the pontoon compartment 15 for control purposes.

A foam wall plate 26 rises vertically upwards from the cover plate 7*a*, 7*b* of the cover 6 near the peripheral seal 20. Furthermore, FIG. 1 shows a plurality of floating roof supports 27, evenly distributed over the cover 6, which are held in guide members and are adjustable to a desired height. The floating roof supports 27, which project beyond the underside of the cover 6, serve to carry the cover 6 on the container bottom 2 whenever the vertical round container 1 is in an emptied state, so that the underside of the cover 6 is accessible, for example for maintenance purposes.

The container 1 is equipped with a line system which is connected to a central unit 28. The line system comprises a respective supply/discharge line 29 which connects each trim compartment 14 and the vapor ring compartment 12 to the central unit 28. The connection, which is passed through the storage liquid 4 underneath the cover 6, is established by three rigid line sections 30 which are connected via articulated adapters 31. Owing to these articulated adapters 31 the supply/discharge line 29 can adapt to the different height positions of the cover 6 with a varying liquid surface 5.

In addition, there is provided a water outlet line 32, extending from the pot-shaped recess 11, which line in turn is composed of three rigid line sections 33 and three articulated sections 34, corresponding to the supply/discharge line 29. Water collected in the tub 8 is drained via this water outlet line 32 into a drainage channel 35 outside of the container 1 via a shut-off valve 36. At the other side of the water outlet line 32, both a pneumatic valve 37 and a hand valve 38 are positioned in the area of the pot-shaped recess 11 to drain water out of the tub 8 by remote control, e.g. from a central measuring station, or in the event of failure of this system, then via the hand valve 38. Since the water outlet line 32 is given a relatively large size, thereby showing a specific stability, this outlet line 32 can serve to hold and support the much smaller supply/discharge lines 29 and the corresponding line sections 30, respectively.

Suction lines 39 for drawing off vapors are provided in special emission zones of the cover. As can particularly be seen in detail drawing A, this is a suction line 39 which draws off the vapors from the ring compartment 16 underneath the primary seal 18, and a further suction line 39 which draws off gases from the space 24 between the primary seal 18 and the secondary seal 19. Further suction lines can be connected to fittings and to measuring and guiding elements of the floating cover 6, which are not shown here. These lines 39 are also passed to the central control unit 28. Finally, various level measuring devices are provided in the following way:

Level measuring devices 40*a* are positioned on the edge of the cover 6 in the area of the ring chamber 16 to determine the floating position of the cover 6 relative to the liquid level 5*a*. Further level measuring devices are provided in every trim compartment 14 and in the vapor ring compartment 12 to determine the liquid level 5*b*, 5*c* in the individual compartments.

Finally, a level measuring device 41 is also positioned in the area of the tub 8.

Overpressure/vacuum safety devices 45, which are connected to the cover plates 7*b*, 7*c*, are assigned as additional safety devices to each trim compartment and the vapor ring compartment.

It should be noted that all lines, no matter whether these are supply/discharge lines 29 for gaseous media, suction lines 39 or measurement and control lines 42, 43, e.g. for level regulation, are passed through the storage liquid 4 along the rigid line sections 32.

Figure 3:
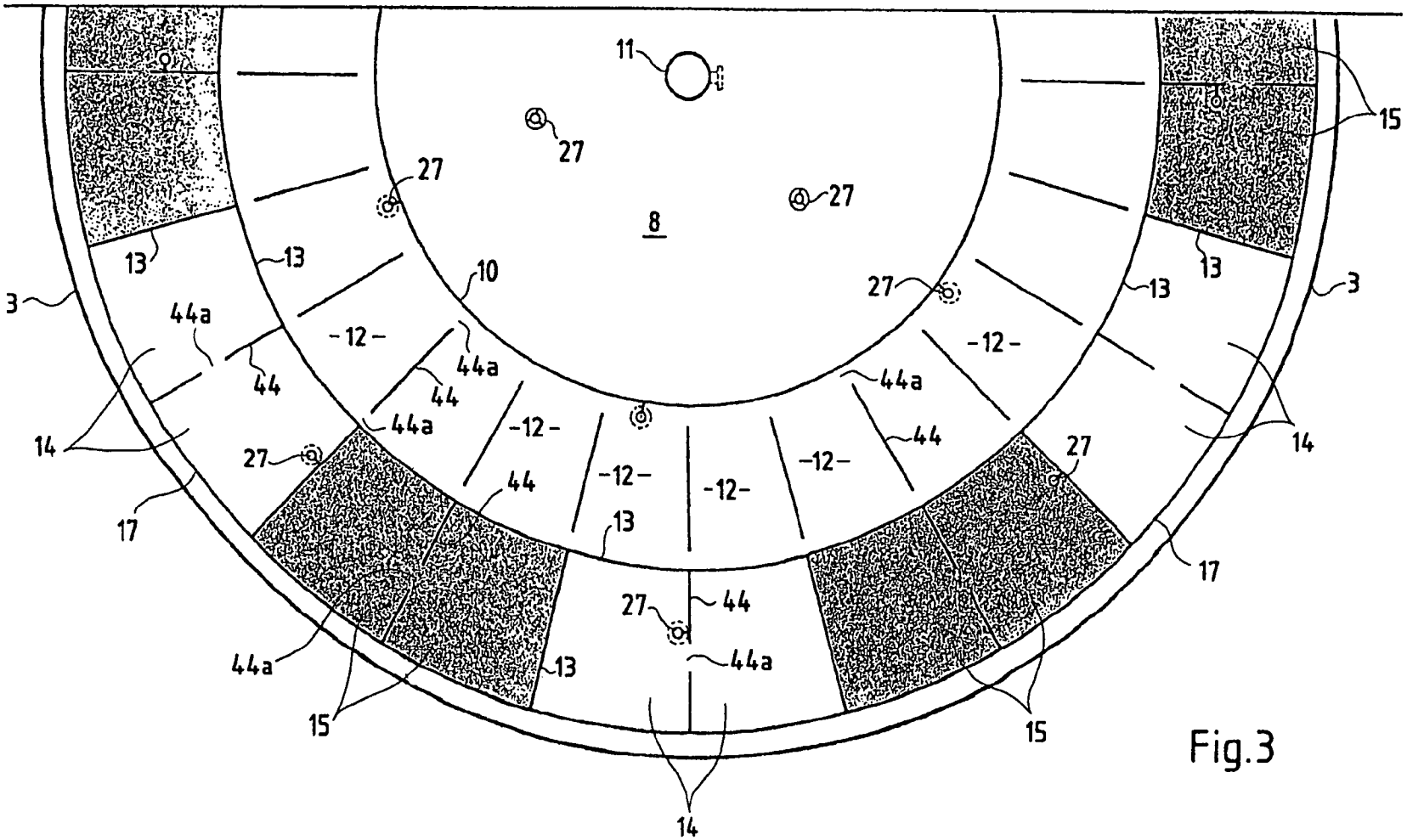
FIG. 3 is a horizontal section through the round container of FIG. 1 along the sectional line III-III in FIG. 1, but only for the steel construction of the container with floating cover.

FIG. 3 shows a section taken through the round container 1 of FIG. 1 along the sectional line III-III to show the subdivisions of the compartments arranged in the two outer rings. The outer ring has arranged therein in alternating fashion a trim compartment 14, i.e. a compartment that is open towards the storage liquid 4 on the underside, and a pontoon compartment 15, i.e. a compartment that is closed on the liquid side.

The large-volume trim compartments 14 and pontoon compartments 15 are however protected by vertical compartment reinforcements 44 against dents. Connection openings 44*a* are positioned in the upper area of the compartment reinforcements 44. Likewise, connection openings 44*a* are provided in all compartment reinforcements 44 of the vapor ring compartment 12, so that the vapor ring compartment 12 for gases forms a single chamber.

On the right container wall 3, near the container bottom 2, the container wall has provided thereon an inlet pipe 46 which, while being directed towards the container center, carries an inlet diffuser 47 through which the storage liquid flows into the container. The inlet diffuser 47 has the function to prevent swirls in the liquid chamber caused by high inlet velocities. With specific filling operations, e.g. unloading of a ship or filling via pipeline, air or gas may enter together with the liquid. The gases rising in the liquid accumulate underneath the floating cover 6.

The purpose of the different functional zones of the floating cover 6 can be explained with reference to FIGS. 1 and 3.

If air or gas enters while the container 1 is being filled, the gaseous medium can rise into the vapor ring compartment 12.

Since the vapor ring compartment 12 is a one-part chamber, the entry of gaseous medium does not lead to an uneven distribution of the buoyant force over the area, but to a uniform increase in buoyancy for the floating cover. Gaseous medium entering, however, into the trim compartments 14 can be displaced via the supply/discharge lines 29, in combination with the central unit 28, into the vapor ring compartment 12.

Upon occurrence of an eccentric load on the floating cover 6, e.g. caused by a one-sided snow load, the floating cover will develop a list which might be enhanced by moving water quantities in the tub 8 and uneven frictional forces on the edge of the floating cover and endanger the safe floating position.

Gaseous medium can now be removed by means of the supply/discharge lines 29 and the central unit 28 from a trim compartment 14, which is diametrically opposite the list of the floating cover 6, and can be pressed into a trim compartment 14 in the area of the list. The floating cover is thereby moved again into its horizontal float position.

The pontoon compartments 15, the vapor ring compartment 12 and the tub 8 provide the basic load of buoyancy, with the buoyant forces of the vapor ring compartment 12 and the tub 8 being variable. What can not be changed are only the buoyant forces of the pontoon compartments 15.

Figure 7:
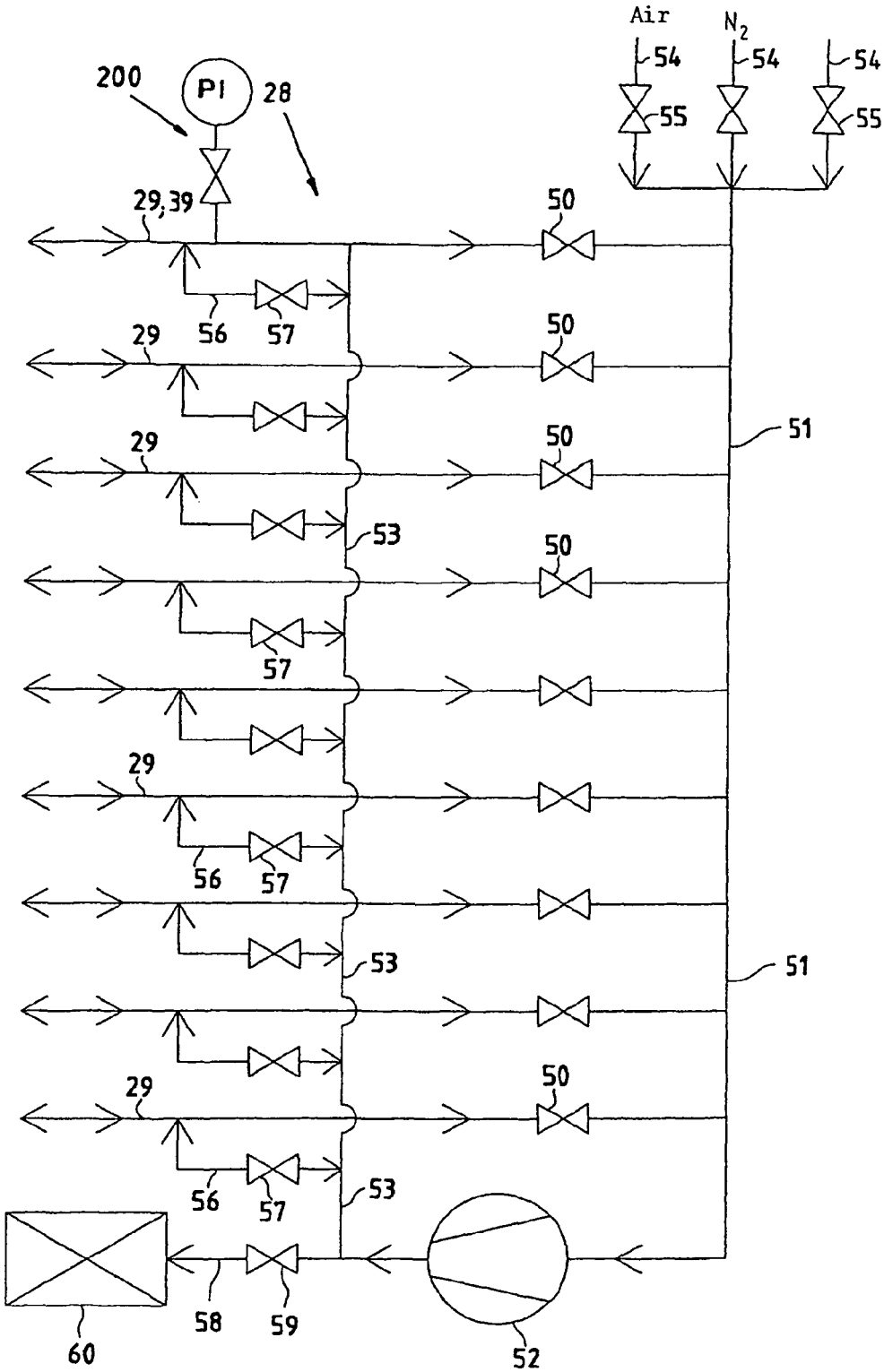
FIG. 7 is a schematic illustration of the structure of the central unit, as can be seen in FIGS. 1 and 2.

To carry out the transfer operations underneath the compartments that are open towards the liquid, the central unit 28 is equipped with a line and valve system, as is schematically shown in FIG. 7.

The central unit 28 comprises a number of supply/discharge lines 29 leading to the floating cover 6. All of the supply/discharge lines 29 are connected via a respective shut-off valve 50 to a collection line 51 and a compressor 52.

Feed lines 53 for air, protective gas and other gaseous media, which are shut off by valves 55, are also connected to the collection line 51.

At the output side of the compressor 52 a distributor line 53 is provided with branch lines 56 leading to each supply/discharge line 29, these lines being adapted to be shut off by valves 57, as well as an output line 58 which leads e.g. to a vapor recovery system 60 or a refinery gas line, connectable via a valve 59.

Each supply/discharge line 29 can be connected to each other supply/discharge line 29 via the compressor 52 with the line and valve arrangement of the illustrated central gas control unit 28. All valves, which are shown in FIG. 7, are controllable individually. Furthermore, direct gas and pressure compensation between the buoyancy compartments is possible via the valves 57.

Hence, vapors entrapped beneath the floating cover 6 can be replaced underneath the trim compartments 14 for maintaining the horizontal floating position. In case of leakage external air can be introduced into the appropriate compartments 12, 14 for maintaining the necessary buoyancy.

To reduce the risk of fire and to mitigate corrosive action, inert gases or dried air, respectively, can be introduced into the compartments that are open towards the liquid.

Furthermore, a pressure measuring device, which is represented in FIG. 7 for instance by unit 200, is provided for each compartment 12, 14.

The switching scheme of the central unit 28 of FIG. 7 can be changed for a prescribed period provided that the above-mentioned connection option for the individual compartments is enabled via the compressor.

Figure 2:
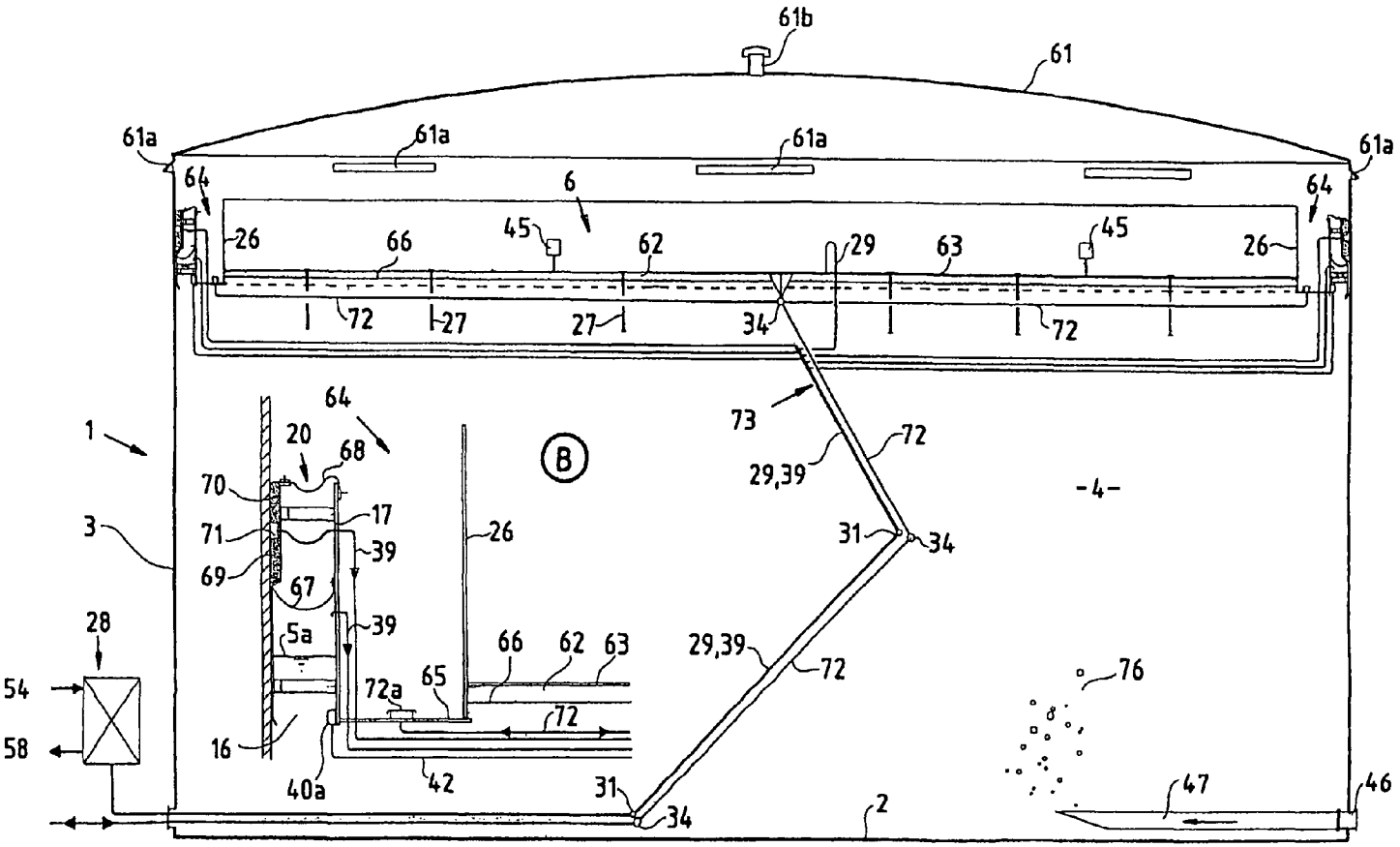
FIG. 2 is a section corresponding to FIG. 1, but with a round container with fixed roof, including a detail B which shows a suitable sealing system for floating covers of a small overall height.

While a container 1 that is open at its upper side has been described with reference to FIG. 1, FIG. 2 shows a round container 1 that is closed on its upper side with a fixed roof 61, aerated via vent holes 61*a*, 61*b*.

It should be noted that in the individual figures, insofar as identical or similar structural members are shown, these are designated throughout the individual figures with the same reference numerals, so that the illustration for one figure can be applied by analogy to the respective other figure, without the structural member being once again described in detail for the other figure.

Since the interior of the container 1 of FIG. 2 is covered by the fixed roof 61, no water-collecting tub is formed in the central region of the floating cover 6.

The floating cover 6 comprises an individual vapor collection compartment 62 which is open towards the storage liquid and formed by a covering membrane 63 and a ring-like box 64 immersed at the container wall side into the liquid 4, which, in turn, consists of an outer peripheral plate 17, an inner foam wall plate 26 and a bottom plate 65.

A vapor cushion is always located between membrane 63 and liquid surface 66. To increase the float stability, individual pontoon compartments may be directly welded to the membrane 63.

A supply/discharge line 29, with connection to the central gas control unit 28, is connected to the vapor collection compartment 62 in the center of the membrane 63.

When the container is being filled and emptied, vapors can be discharged via the gas control unit 28 out of the container, as in the case of excessive vapor underneath the membrane 63 at high operating temperatures.

The detail drawing B in FIG. 2 shows a peripheral seal 20 which is modified in comparison with the detail drawing A in FIG. 1. The peripheral seal 20 comprises a combined primary/secondary seal with a primary sealing blanket 67 and a secondary sealing blanket 68 and two sealing elements 69 and 70 on the container wall side, with an interposed gas chamber 71.

Suction lines 39 are passed to the vapor chamber between liquid level 5*a* and primary sealing blanket 67 and to the gas chamber 71.

At high storage temperatures the membrane 63 will bulge upwards, thereby increasing the vapor chamber. The whole floating cover 6 floats on a vapor cushion that increases in size.

Excessive vapor can be pressed out of the ring chamber 16 underneath the primary sealing blanket 67 by means of the suction line 39 and the gas control unit 28 into the vapor collection chamber 62.

Possible vapor emissions can be sucked out of the gas chamber 71 between the sealing elements 69 and 70 by means of the suction line 39 by the central gas control unit 28 and supplied to a vapor recovery device 60.

The arrangement is additionally provided with a supply line 72 via which fire foam can be supplied at openings 72*a*. This line 72 can also be designed, in case of overfilling, as a withdrawal line out of this area. Such overfilling may occur, for example when the storage container has been overfilled by mistake.

It should be noted that all lines, as are also described in FIG. 2, are passed via the central tube system 73 through the storage liquid 4.

Figure 4A:
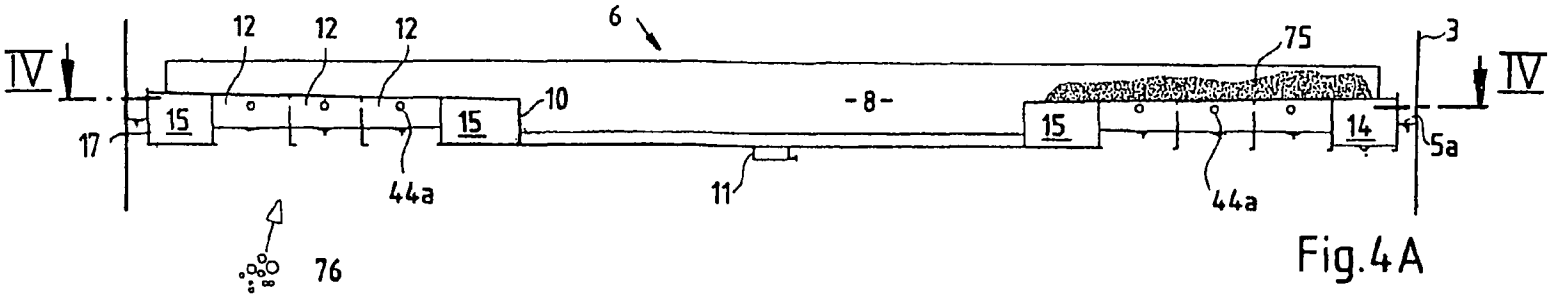
FIG. 4A is a schematic vertical sectional view of a further floating cover.
Figure 4B:
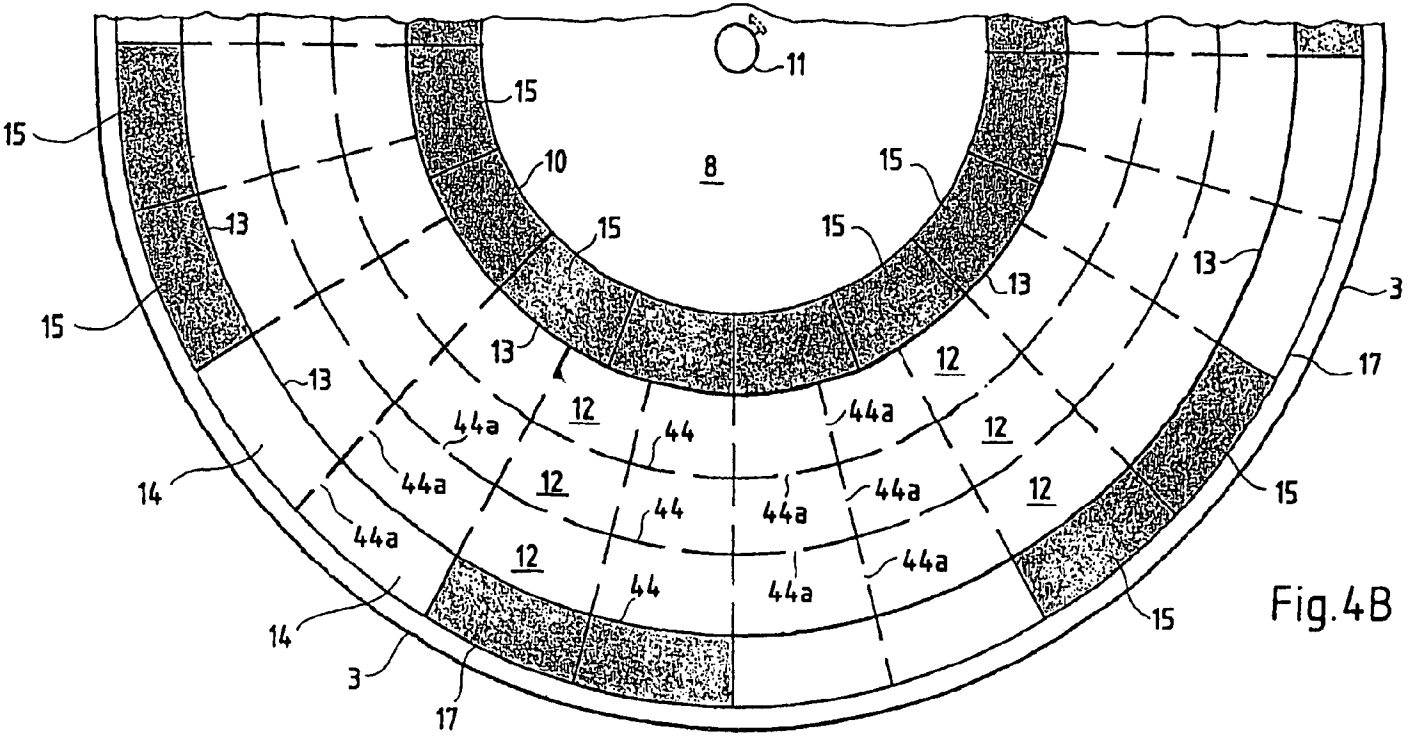
FIG. 4B is a schematic illustration which shows the division of the floating cover into compartments, along the sectional line IV-IV in FIG. 4A.

FIGS. 4A and 4B schematically show a further construction of the floating cover, which is suited for containers with a large diameter.

In contrast to the embodiment shown in FIG. 1, a further ring with individual pontoon compartments 15 is connected on the outer edge of the tub 8, and the area of the vapor ring compartment 12 is increased.

Finally, a further ring is positioned radially further to the outside, where in conformity with FIG. 3 pontoon compartments 15 and trim compartments 14 are distributed in alternating fashion. According to the embodiments shown in FIGS. 1 and 3, the trim compartments 14 and the vapor ring compartment 12 can be filled or emptied via the central unit 28 with different quantities of gas/vapor to adjust the horizontal float position and to discharge excessive gas, if necessary.

In FIG. 4*a*, reference numeral 75 designates snow loads and reference numeral 76 designates gases or vapors introduced into the container. The disruption of the horizontal float position caused thereby can be compensated by shifting vapor quantities into the trim compartments 14.

The illustrated construction may serve as an inexpensive alternative to the floating covers of double membrane construction, which are normally used for containers having a diameter of more than 60 m.

Figure 5:
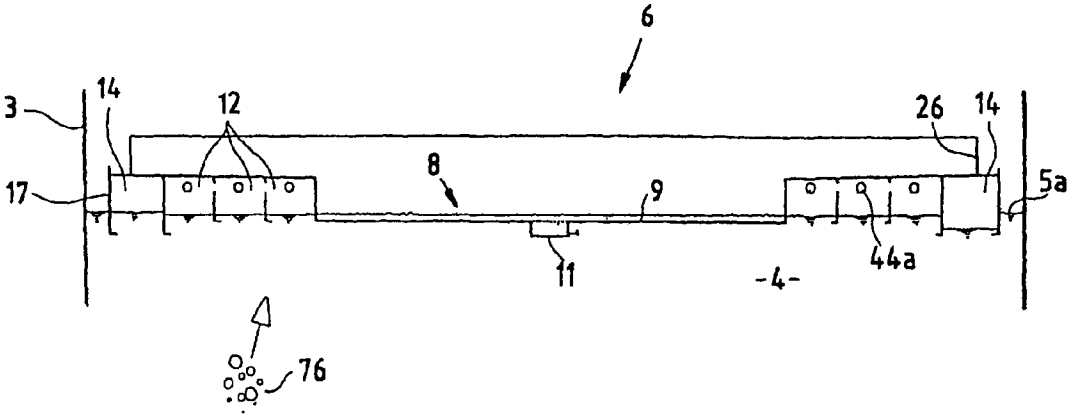
FIG. 5 is a section, comparable with the sectional illustration of FIG. 4A, through a further design of a floating cover.

FIG. 5 shows a further embodiment of the floating cover 6, which can be regarded as an inexpensive design for smaller container diameters.

There are no closed pontoon compartments in this embodiment, but only an external ring with trim compartments 14 and a radially inwardly following vapor ring compartment 12, as well as a tub 8.

Figure 6:
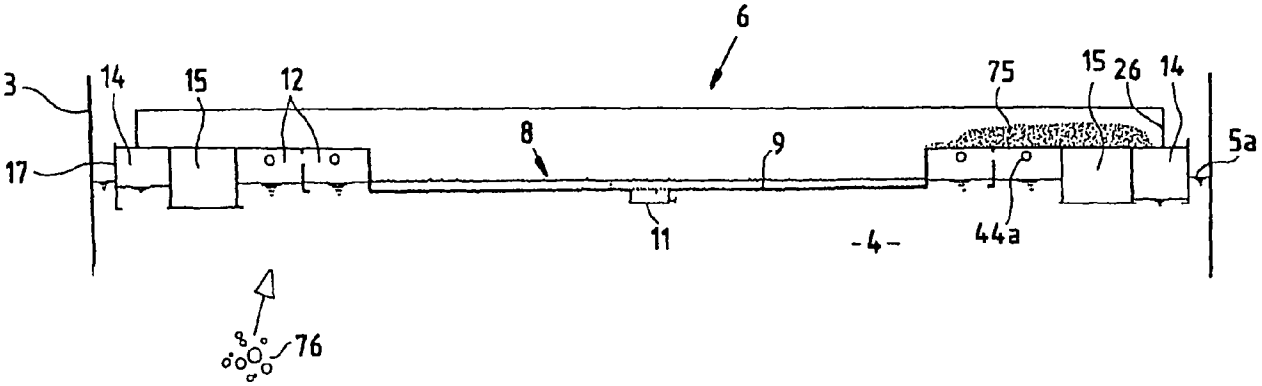
FIG. 6 is a further sectional illustration, comparable with that of FIG. 5, for a further design of a floating cover.

FIG. 6 shows a further embodiment of the floating cover 6, which is also expedient for large container diameters. The outer ring includes trim compartments 14.

This outer ring is followed radially inwards by a ring comprising individual pontoon compartments 15 as well as a vapor ring compartment 12 and a tub 8.

On containers having a floating cover, leakage damage due to individual pontoon compartments 15 breaking up are often observed after foundation settlements and after the container wall 3 has lost its roundness, as a result of which the floating cover may descend.

In the embodiment shown in FIG. 6, the pontoon ring 15, which is important for the floating stability, cannot be impaired by deformations of the container wall 3 because it is not arranged on the outer rim of the floating cover 6. Possible deformations on the trim compartments 14, however, do not result in any major problems for the float position.

With all the designs of the floating cover 6 for containers without a roof, corresponding to FIGS. 1, 4, 5, 6, large surface areas are occupied by trim compartments 14, pontoon compartments 15 and the vapor ring compartment 12, so that the tub 8 is given a relatively small basic area and shows a greater height for compensating purposes. The water quantities collected on the floating cover therefore stay closer to the center of the floating cover and can hardly impair the horizontal float position.

If several storage containers 1 are present for the same storage product, it is advisable to provide a joint central unit 28 for all storage containers of this group of products. This makes it possible to reduce the excessive quantities of vapor to be cleaned, by way of a corresponding compensation of the vapor quantities to be shifted underneath the individual storage containers.

Figure 8:
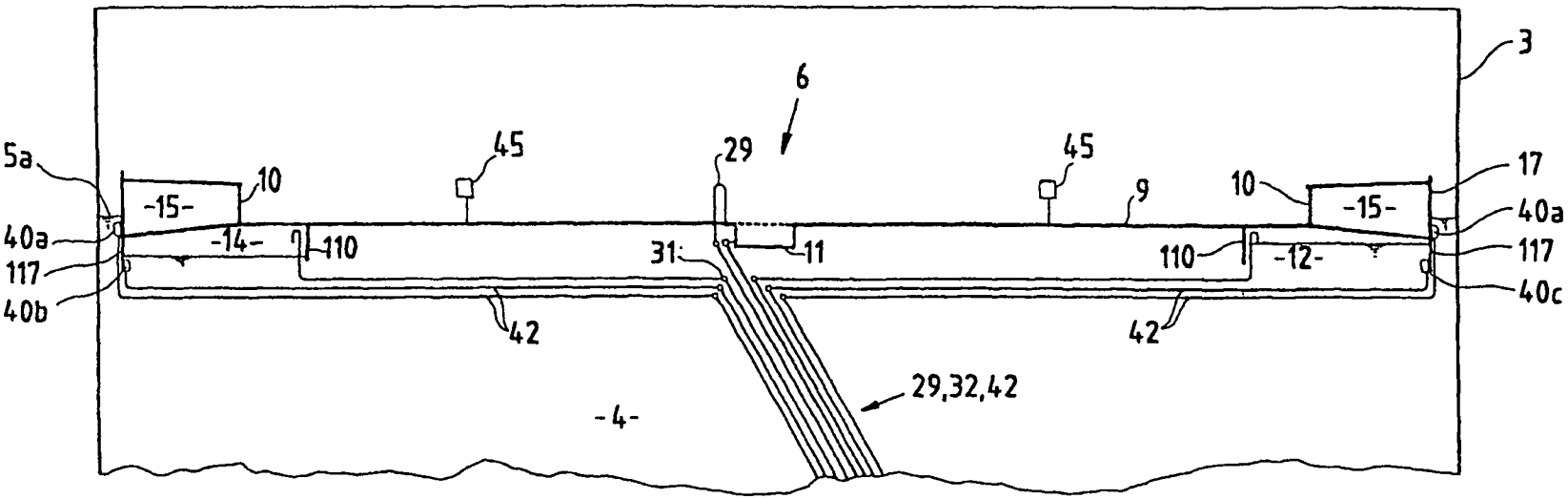
FIG. 8 shows a floating cover retrofitted with trim compartments and a vapor ring compartment.

FIG. 8 shows an expedient retrofitting of an existing floating cover 6 with a trim compartment 14. A peripheral ring made up of individual pontoons 15 and the tub bottom 9 have arranged thereunder on the outside a peripheral plate 117 and on the inside a peripheral plate 110, and in peripheral direction the necessary compartment reinforcements and partition walls, which are here not shown.

The space under the tub bottom 9 and the trim compartments 14 are equipped with supply/discharge lines 29 that permit a displacement of vapors and a discharge/supply line of gases, respectively, via a central unit 28, as has been explained above. Likewise, it is possible to arrange downwardly open vapor collection compartments alternating with trim compartments 14 on the circumference of the floating cover 6, these vapor collection compartments forming a vapor ring compartment 12 through interconnections at the gas side, the vapor ring compartment 12 generating uniform buoyancy over the whole surface.

There has thus been shown and described a novel vertical round container for storing liquids, and arrangement comprising a plurality of containers which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A bulk storage container comprising, in combination:

(a) a horizontal bottom wall and a round vertical side wall extending upward from the bottom wall, said walls defining a container space for a liquid;

(b) a floating cover arranged within the side wall and configured to float on a surface of a liquid in the container, said cover being sealed in relation to the side wall by means of a flexible seal permitting vertical movement of the cover as the surface of a liquid in the container is raised and lowered, said cover having a plurality of open compartments on a lower side thereof facing such a liquid, if present, which are open toward such a liquid and which trap any gaseous media emanating from such a liquid;

(c) a sensor device with at least three sensing elements located around a periphery of the cover for sensing the position of the cover with respect to the surface of such a liquid, if present;

(d) a gas control unit having a gas compressor, a plurality of gas lines and a plurality of valves in said gas lines, said gas lines interconnecting the compressor and the plurality of open compartments on the lower side of the cover for controlling the gas pressure within said plurality of open compartments;

wherein the gas control unit is responsive to the sensor device and operative to adjust the horizontal orientation of the cover through displacement of gaseous media between said plurality of open compartments.

2. The container according to claim 1, wherein the gas control unit is part of a common central unit connected to all open compartments of said cover via said gas lines.

3. The container according to claim 2, wherein each open compartment is connected to a single gas line which is usable either as a supply line or as a discharge line.

4. The container according to claim 3, wherein an immersion depth of the cover is determined at a plurality of points on an edge of the cover; wherein at least three of said open compartments are distributed at least around a peripheral portion of the cover and serve as trim compartments; and wherein each open compartment is connected via a separate one of said gas lines to the gas control unit.

5. The container according to claim 4, wherein the gas lines are passed through the liquid in said container to one of a lower container edge and the bottom wall of the container.

6. The container according to claim 5, wherein the gas lines that pass through the liquid are composed of rigid line sections that are connected by articulated adapters.

7. The container according to claim 6, wherein said articulated adapters are flexible hose joints.

8. The container according to claim 4, wherein the cover further comprises a plurality of pontoon compartments, each closed at the liquid side, arranged to alternate with the open trim compartments, when viewed in a circumferential direction.

9. The container according to claim 8, wherein the trim compartments are disposed beneath the pontoon compartments.

10. The container according to claim 4, wherein the cover further comprises at least one concentric vapor ring compartment which is connected via a separate gas line to the central unit.

11. The container according to claim 10, wherein the vapor ring compartment is arranged in a position closer to a center of the cover than the trim compartments.

12. The container according to claim 10, wherein the vapor ring compartment, formed by vapor collection compartments, is arranged beneath the pontoon compartments.

13. The container according to claim 2, wherein the central unit is connected to external gas supply lines for air and other gases and to an external vapor discharge line for the container.

14. The container according to claim 2, further comprising gaseous media suction lines, connected to the central unit, that extend to an area of the flexible seal of the cover.

15. An arrangement comprising a plurality of containers according to claim 2, wherein said containers are all connected to the common central unit.

16. The container according to claim 1, wherein the cover further comprises a tub, formed at a center of the cover, that extends toward the liquid in the container with a bottom of the tub immersed into the liquid.

17. The container according to claim 16, wherein the tub is provided with a water level sensing device and a water level regulating device.

18. The container according to claim 1, further comprising at least one of a water outlet line, a feed line for fire foam and at least one other feed and discharge line connected to the cover.

19. The container according to claim 1, wherein a gas line connected to each open compartment is inter-connectable via said valves and said gas compressor to a gas line connected to each other open compartment.

* * * * *